US006795997B1

(12) United States Patent
Lin

(10) Patent No.: US 6,795,997 B1
(45) Date of Patent: Sep. 28, 2004

(54) DUST CLEANING BRUSH ASSEMBLY

(76) Inventor: Chai Hao Lin, No. 146, Sec. 1, Jungshan Rd., Huatan Shiang, Changhua (TW), 503

( * ) Notice: Subject to any disclaimer, the term of this patent is extended or adjusted under 35 U.S.C. 154(b) by 0 days.

(21) Appl. No.: 10/420,710

(22) Filed: Apr. 23, 2003

(51) Int. Cl.[7] ..... A46B 9/10; A46B 17/04
(52) U.S. Cl. ..... 15/184
(58) Field of Search ..... 15/184, 169

(56) References Cited

U.S. PATENT DOCUMENTS 1,749,052 A * 3/1930 Denby ..... 15/184
3,205,523 A * 9/1965 Seaver ..... 15/184
2003/0126706 A1 * 7/2003 Lee ..... 15/169

* cited by examiner

*Primary Examiner*—Randall Chin
(74) *Attorney, Agent, or Firm*—Rosenberg, Klein & Lee

(57) ABSTRACT

A dust cleaning brush assembly includes a fixing seat, a rotation barrel, an outer ornament barrel, and a brush rod. Thus, the dust cleaning brush assembly can be operated easily and conveniently. In addition, the bristles of the brush rod is fully hidden in the outer ornament barrel when not in use, thereby enhancing the aesthetic quality of the dust cleaning brush assembly. Further, the rotation barrel is mounted on the fixing seat, and the sucker of the fixing seat can be attached on the table, so that the dust cleaning brush assembly is disposed at an upright state without occupying the space.

10 Claims, 3 Drawing Sheets

DUST CLEANING BRUSH ASSEMBLY

BACKGROUND OF THE INVENTION

1. Field of the Invention

The present invention relates to a dust cleaning brush assembly, and more particularly to a dust cleaning brush assembly that can be operated easily and conveniently.

2. Description of the Related Art

A conventional dust cleaning brush in accordance with the prior art shown in FIG. 1 comprises a handle 1, and a plurality of bristles 11 mounted on the top of the handle 11. Thus, the conventional dust cleaning brush can be used to clean and remove the dust, dirt or the like. However, the bristles 11 protrude outward from the handle 11 when not in use, thereby decreasing the aesthetic quality of the conventional dust cleaning brush.

SUMMARY OF THE INVENTION

The present invention is to mitigate and/or obviate the disadvantage of the conventional dust cleaning brush.

The primary objective of the present invention is to provide a dust cleaning brush assembly that can be operated easily and conveniently.

Another objective of the present invention is to provide a dust cleaning brush assembly, wherein the bristles of the brush rod is fully hidden in the outer ornament barrel when not in use, thereby enhancing the aesthetic quality of the dust cleaning brush assembly.

A further objective of the present invention is to provide a dust cleaning brush assembly, wherein the rotation barrel is mounted on the fixing seat, and the sucker of the fixing seat can be attached on a horizontal face, such as the table, so that the dust cleaning brush assembly is disposed at an upright state without occupying the space.

A further objective of the present invention is to provide a dust cleaning brush assembly, wherein the outer ornament barrel is formed with an ornament, thereby enhancing the aesthetic quality of the dust cleaning brush assembly.

In accordance with the present invention, there is provided a dust cleaning brush assembly, comprising a rotation barrel, an outer ornament barrel, and a brush rod, wherein:

the rotation barrel has an upper end formed with an insertion section having a wall formed with a receiving hole for receiving a rolling ball;

the outer ornament barrel is rotatably mounted on the rotation barrel and has an inner wall formed with a plurality of elongated slideways; and the brush rod is slidably mounted in the rotation barrel and has an upper end formed with a plurality of opposite guide ribs each slidably mounted in a respective one of the slideways of the outer ornament barrel and a lower end formed with a helical outer thread for receiving and guiding the rolling ball of the rotation barrel.

Further benefits and advantages of the present invention will become apparent after a careful reading of the detailed description with appropriate reference to the accompanying drawings.

DETAILED DESCRIPTION OF THE INVENTION

Figure 1:
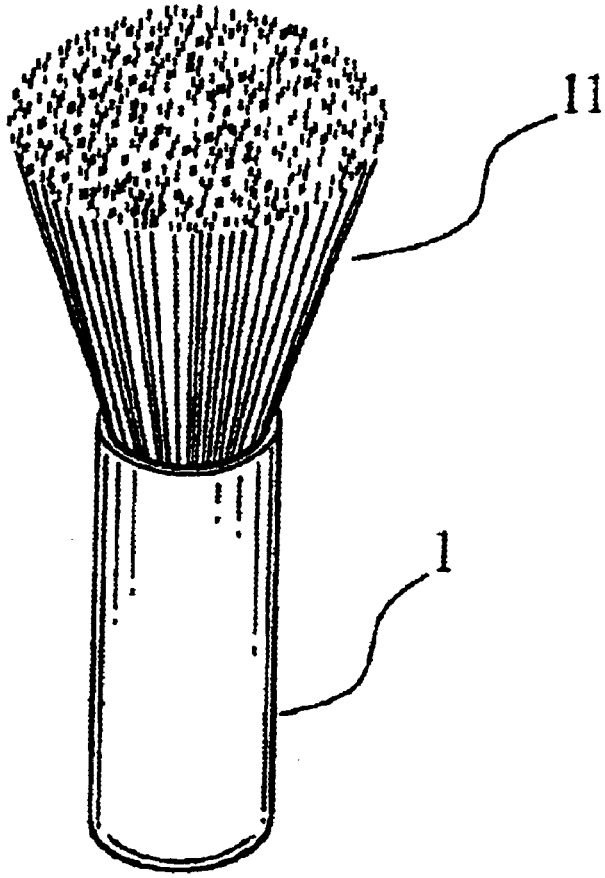
FIG1 PRIOR ART
FIG. 1 is a perspective view of a conventional dust cleaning brush in accordance with the prior art.
Figure 2:
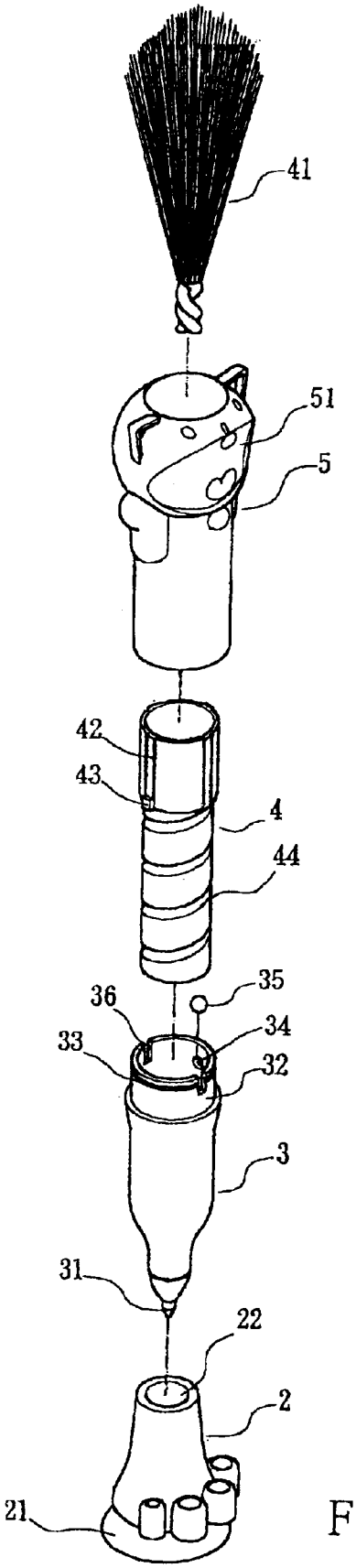
FIG. 2 is an exploded perspective view of a dust cleaning brush assembly in accordance with the preferred embodiment of the present invention.
Figure 3:
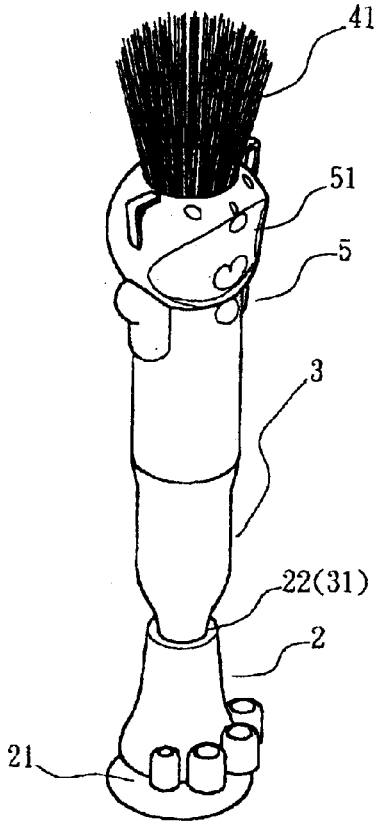
FIG. 3 is a perspective assembly view of the dust cleaning brush assembly in accordance with the preferred embodiment of the present invention.
Figure 4:
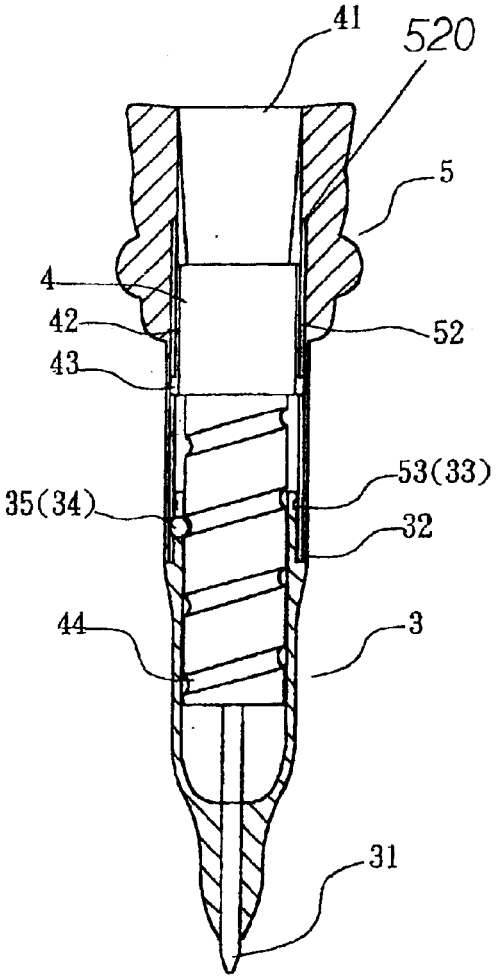
FIG. 4 is a front plan cross-sectional view of the dust cleaning brush assembly as shown in FIG. 3.

Referring to the drawings and initially to FIGS. 2–4, a dust cleaning brush assembly in accordance with the preferred embodiment of the present invention comprises a fixing seat 2, a rotation barrel 3, a brush rod 4, and an outer ornament barrel 5.

The fixing seat 2 has a bottom provided with a sucker 21. The fixing seat 2 has an inside formed with an insertion hole 22.

The rotation barrel 3 is mounted on the fixing seat, 2. The rotation barrel 3 has an upper end formed with an annular insertion section 32 having a reduced diameter. The insertion section 32 of the rotation barrel 3 has an outer periphery formed with an annular groove 33. The insertion section 32 of the rotation barrel 3 has a wall formed with a receiving hole 34 for receiving a rolling ball 35. The insertion section 32 of the rotation barrel 3 has a top formed with two radially opposite openings 36 to facilitate assembly of the rotation barrel 3. The rotation barrel 3 has a lower end provided with a tip 31 inserted into the insertion hole 22 of the fixing seat 2 for writing use.

The brush rod 4 is slidably mounted in the rotation barrel 3 and has a top provided with a plurality of bristles 41. The brush rod 4 has an upper end formed with a plurality of opposite guide ribs 42 each having a bottom provided with a protruding boss 43 to provide a stop effect. The brush rod 4 has a lower end formed with a helical outer thread 44 for receiving and guiding the rolling ball 35 of the rotation barrel 3.

Figure 5:
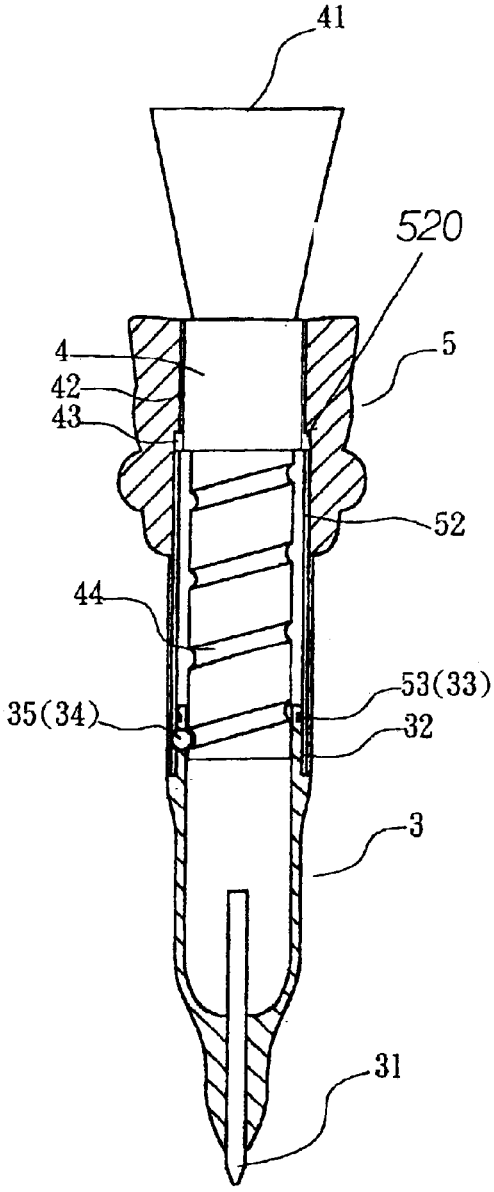
FIG. 5 is a schematic operational view of the dust cleaning brush assembly as shown in FIG. 4 in, use.

The outer ornament barrel 5 is rotatably mounted on the rotation barrel 3. The outer ornament barrel 5 has an outer wall formed with an ornament 51. The outer ornament barrel 5 has an inner wall formed with a plurality of elongated slideways 52. Each of the guide ribs 42 of the brush rod 4 is slidably mounted in a respective one of the slideways 52 of the outer ornament barrel 5, and the protruding boss 43 of each of the guide ribs 42 of the brush rod 4 is rested on a top wall 520 of the respective slideway 52 of the outer ornament barrel 5 when the brush rod 4 is lifted to the uppermost position as shown in FIG. 5. The inner wall of the outer ornament barrel 5 has a lower portion formed with a plurality of locking ribs 53 forced into and locked in the annular groove 33 of the rotation barrel 3, so that the outer ornament barrel 5 is rotatably mounted on the rotation barrel 3 without detachment.

In operation, referring to FIGS. 4 and 5 with reference to FIGS. 2 and 3, the rotation barrel 3 can be rotated relative to the outer ornament barrel 5 to rotate the rolling ball 35 which is guided and moved in the helical outer thread 44 of the brush rod 4, thereby forcing the brush rod 4 to move upward, so that the brush rod 4 can be moved from the position as shown in FIG. 4 to the position as shown in FIG. 5, thereby exposing the bristles 41 of the brush rod 4, such that the bristles 41 of the brush rod 4 fully protrudes outward from the outer ornament barrel 5 for use.

In addition, when the brush rod 4 is lifted to the uppermost position as shown in FIG. 5, the protruding boss 43 of each of the guide ribs 42 of the brush rod 4 is rested on the top wall 520 of the respective slideway 52 of the outer ornament barrel 5, thereby preventing the brush rod 4 from detaching from the outer ornament barrel 5.

When not in use, the rotation barrel 3 can be rotated relative to the outer ornament barrel 5 in the reverse direction to rotate the rolling ball 35 which is guided and moved in the helical outer thread 44 of the brush rod 4, thereby forcing the brush rod 4 to move downward, so that the brush rod 4 can be moved from the position as shown in FIG. 5 to the position as shown in FIG. 4, thereby retracting the bristles 41 of the brush rod 4, such that the bristles 41 of the brush rod 4 is fully hidden in the outer ornament barrel 5.

Accordingly, the dust cleaning brush assembly can be operated easily and conveniently. In addition, the bristles 41 of the brush rod 4 is fully hidden in the outer ornament barrel 5 when not in use, thereby enhancing the aesthetic quality of the dust cleaning brush assembly. Further, the rotation barrel 3 is mounted on the fixing seat 2, and the sucker 21 of the fixing seat 2 can be attached on a horizontal face, such as the table, so that the dust cleaning brush assembly is disposed at an upright state without occupying the space. Further, the outer ornament barrel 5 is formed with an ornament 51, thereby enhancing the aesthetic quality of the dust cleaning brush assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A dust cleaning brush assembly, comprising a rotation barrel, an outer ornament barrel, and a brush rod, wherein:

the rotation barrel has an upper end formed with an insertion section having a wall formed with a receiving hole for receiving a rolling ball;

the outer ornament barrel is rotatably mounted on the rotation barrel and has an inner wall formed with a plurality of elongated slideways; and the brush rod is slidably mounted in the rotation barrel and has an upper end formed with a plurality of opposite guide ribs each slidably mounted in a respective one of the slideways of the outer ornament barrel and a lower end formed with a helical outer thread for receiving and guiding the rolling ball of the rotation barrel.

2. The dust cleaning brush assembly in accordance with claim 1, wherein the insertion section of the rotation barrel has an annular shape with a reduced diameter.

3. The dust cleaning brush assembly in accordance with claim 1, wherein the insertion section of the rotation barrel has an outer periphery formed with an annular groove, and the inner wall of the outer ornament barrel has a lower portion formed with a plurality of locking ribs forced into and locked in the annular groove of the rotation barrel, so that the outer ornament barrel is rotatably mounted on the rotation barrel without detachment.

4. The dust cleaning brush assembly in accordance with claim 1, wherein the insertion section of the rotation barrel has a top formed with two radially opposite openings.

5. The dust cleaning brush assembly in accordance with claim 1, wherein the brush rod has a top provided with a plurality of bristles.

6. The dust cleaning brush assembly in accordance with claim 1, wherein each of the of opposite guide ribs of the brush rod has a bottom provided with a protruding boss rested on a top wall of the respective slideway of the outer ornament barrel when the brush rod is lifted to the uppermost position.

7. The dust cleaning brush assembly in accordance with claim 1, wherein the outer ornament barrel has an outer wall formed with an ornament.

8. The dust cleaning brush assembly in accordance with claim 1, further comprising a fixing seat, wherein the rotation barrel is mounted on the fixing seat.

9. The dust cleaning brush assembly in accordance with claim 8, wherein the fixing seat has a bottom provided with a sucker.

10. The dust cleaning brush assembly in accordance with claim 8, wherein the fixing seat has an inside formed with an insertion hole, and the rotation barrel has a lower end provided with a tip inserted into the insertion hole of the fixing seat.

* * * * *